United States Patent [19]

Pahl et al.

[11] 4,194,364

[45] Mar. 25, 1980

[54] ARRANGEMENT FOR CONTROLLING THE OPERATION OF A FLUID-DISPLACEMENT MACHINE

[75] Inventors: Arnold Pahl, Ditzingen; Gerhard Nonnenmacher, Korntal, both of Fed. Rep. of Germany

[73] Assignee: Robert Bosch GmbH, Stuttgart, Fed. Rep. of Germany

[21] Appl. No.: 907,867

[22] Filed: May 19, 1978

[30] Foreign Application Priority Data

May 21, 1977 [DE] Fed. Rep. of Germany ..... 2723074

[51] Int. Cl.[2] ..... F16H 39/46

[52] U.S. Cl. ..... 60/445; 60/494; 417/212

[58] Field of Search ..... 60/445, 452, 487, 494; 417/212, 213

[56] References Cited

U.S. PATENT DOCUMENTS

| | | | |
|---|---|---|---|
| 3,856,436 | 12/1974 | Lonnemo | 417/212 |
| 3,959,969 | 6/1976 | Tittmann et al. | 60/445 |
| 3,990,237 | 11/1976 | Van Gerpen | 60/445 |
| 3,995,425 | 12/1976 | Wittren | 60/445 |

*Primary Examiner*—Edgar W. Geoghegan
*Attorney, Agent, or Firm*—Michael J. Striker

[57] ABSTRACT

An arrangement for controlling the operation of a fluid-displacement machine, such as a hydraulic pump or motor, which is equipped with an adjuster that adjusts the machine toward higher and lower throughputs in dependence upon the pressure of a control fluid acting thereon, includes a control valve which communicates the adjuster either with a high-pressure zone or with a low-pressure zone of a control circuit in different ones of its terminal positions. In addition thereto, the arrangement includes a pressure-limiting valve interposed between the low-pressure and the high-pressure zones of the control circuit. Both the control and pressure limiting valves are acted upon by the control fluid, the pressure of which is controlled by a common regulating valve. The control and pressure-limiting valve as well as the associated equipment are so constructed that the magnitude of the force required to move the limiting valve toward the open position exceeds that of the force required to move the control valve toward that position in which the adjuster adjusts the machine toward lower throughputs.

10 Claims, 2 Drawing Figures

ARRANGEMENT FOR CONTROLLING THE OPERATION OF A FLUID-DISPLACEMENT MACHINE

BACKGROUND OF THE INVENTION

The present invention relates to a throughput-adjustable fluid-displacement machine in general, and more particularly to an arrangement for controlling the operation of such a machine.

There are already known various constructions of throughput adjustable fluid-displacement machines which are equipped with throughput-adjusting devices. It is also already known to provide, in connection with a fluid-displacement machine of this type, an additional pressure-limiting valve which serves safety purposes and which also has the function of limiting the pressure peaks during the operation of the machine. Under these circumstances, it can happen that, when the fluid-displacement machine is used in an installation which is being operated at a variable working pressure, the pressure-limiting valve responds to a change in the pressure of the working fluid before the throughput-adjusting device of the fluid-displacement machine. This, of course, can result in an undesirable malfunction in the control operation.

SUMMARY OF THE INVENTION

Accordingly, it is a general object of the present invention to avoid the disadvantages of the prior art.

More particularly, it is an object of the present invention to devise an arrangement for controlling the operation of a throughput-adjustable fluid-displacement machine, which is not possessed of the disadvantages of the control arrangements of this type which are known to the prior art.

Yet another object of the present invention is to develop a control arrangement of the above-identified type which is simple in construction, inexpensive to manufacture, but reliable nevertheless.

In pursuance of these objects and others which will become apparent hereafter, one feature of the present invention resides, in a fluid-flow arrangement of the type including a high-pressure conduit, a throughput-adjustable fluid-displacement machine, a throughput-adjusting device for the machine, and a pressure-limiting valve communicating with the high-pressure conduit, briefly stated, in the improvement comprising a regulating valve commonly associated with the throughput-adjusting device and with the pressure-limiting valve.

More particularly, the present invention resides in an arrangement for controlling the operation of a fluid-displacement machine of the type equipped with an adjuster which adjusts the machine toward higher and lower throughputs in dependence on the pressure of a control fluid acting thereon, which arrangement comprises, in combination, a control circuit for the control fluid, having a high-pressure and a low-pressure zone; a control valve interposed between the adjuster and the above-mentioned zones for movement between two terminal positions in which it respectively communicates the adjuster with a different one of the zones, and having an actuating portion; means for limiting the pressure in the high-pressure zone, including a limiting valve interposed between the zones for movement between respective open and closed positions and also having an actuating portion; and means for simultaneously subjecting both of the actuating portions to respective forces which urge each of the valves toward one of the positions thereof in dependence on the pressure of the control fluid in the high-pressure zone and the magnitudes of which are in a predetermined ratio with respect to one another, including means for communicating the actuating portions of the valves with one another and with at least one of the zones of the control circuit, and a regulating valve interposed in the communicating means between the actuating portion and the one zone. The present invention finds a very advantageous use in an environment in which the high-pressure and low-pressure zone of the control circuit are communicatingly connected with the high-pressure and low-pressure ports of the fluid-displacement machine, respectively.

According to a further concept of the present invention, the control and limiting valves are so constructed that the magnitude of the force required to move the limiting valve toward the open position exceeds that of the force required to move the control valve toward that of the terminal positions in which the adjuster adjusts the machine toward lower throughputs. When the communicating arrangement is constructed in this way, there is obtained an important advantage that it is achieved, in a very simple manner, that is, by resorting to the use of a single common element, that the responding pressure of the control valve is always by a constant selectable value below the responding pressure of the pressure-limiting valve. In this manner, there is obtained a simple, inexpensive and useful possibility of pressure regulation and securing of the fluid-displacement machine.

According to a further facet of the present invention, the communicating means also communicates with the other of the zones, and the regulating valve is arranged between the actuating portions of the control and limiting valves and the low-pressure zone of the control circuit. Advantageously, a throttle is arranged in the communicating means between the high-pressure zone of the control circuit and the actuating portions of the limiting and control valve. Then, it is further advantageous when an additional throttle is arranged in the communicating means between the actuating portions of the limiting and control valve. It is especially advantageous when two throttles are interposed in the communicating means between the high-pressure zone of the control circuit and the regulating valve.

In this context, it is of particular advantage when one of the two throttles is provided in the regulating valve, while the other of the two throttles is arranged in the limiting valve. In this manner, there is obtained a particularly simple and inexpensive construction of the various valves and throttles.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
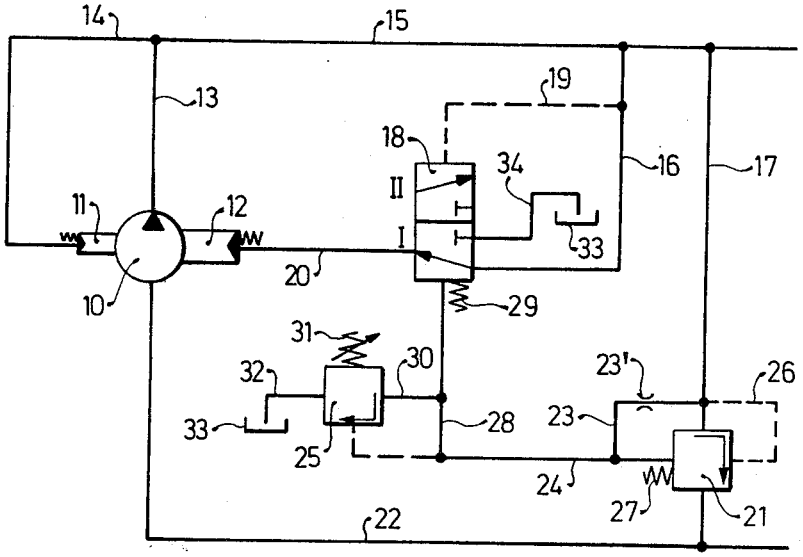
FIG. 1 is a diagrammatic view of an example of an embodiment of the present invention.

Referring now to the drawing in detail, and first to FIG. 1 thereof, it may be seen therein that the reference numeral 10 has been used to designate a throughput-adjustable fluid-displacement machine, such as a radial piston pump, in toto. The throughput of the machine 10 is adjusted, in a conventional manner, by two adjusting pistons 11 and 12 which are supplied with a pressurized control fluid. The adjusting piston 11 has a smaller active area subjected to the pressure of the control fluid than the adjusting piston 12.

The machine or pump 10 expels a fluid into a conduit 13, and a branch conduit 14 leads from the conduit 13 to the adjusting piston 11. Thus, the adjusting piston 11 is being constantly acted upon by the pressure of the fluid at the high-pressure side of the pump 10. The conduit 13 communicates with a user conduit 15, and two branch conuits 16 and 17 branch off from the user conduit 15. The branch conduit 16 leads to a control valve 18 which has been illustrated, for the sake of simplicity, as a three-port two-position valve. The valve is acted upon by the fluid admitted thereto through a control conduit 19 which communicates with the branch conduit 16. A conduit 20 leads from the control valve 18 to the adjusting piston 12 of the larger active area.

The branch conduit 17 leads to a pressure-limiting valve 21. The pressure-limiting valve 21 communicates, at its downstream side, with a suction or low-pressure conduit 22 which, in turn, communicates with the low-pressure side of the pump 10. A communicating conduit 23 branches off from the branch conduit 17, and a throttle 23' is arranged in the communicating conduit 23. The communicating conduit 23 is communicatingly connected to a communicating duct 24 which leads, at its one end, to the pressure-limiting valve 21, and at its other end to a regulating valve 25. A conduit 26 leads to the opposite side of the pressure-limiting valve 21, the conduit 26 also commencing at the branch conduit 17. In addition thereto, a compression spring 27 acts on the pressure-limiting valve 21 from the side of the conduit 24.

A further communicating duct 28 branches off from the communicating duct 24 and leads to the control valve 18, admitting the control fluid thereinto from the opposite side than the control conduit 19. Furthermore, a control spring 29 acts on the control valve 18 from the side of the further communicating duct 28. An additional communicating conduit 30 communicates the communicating duct 28 with the regulating valve 25. The regulating valve 25 is acted upon by an adjustable compression spring 31. A relief conduit 32 communicates the regulating valve 25 with a container 33 for the fluid. Also, the pressure-regulating valve 18 is connected, via a relief conduit 34, with the container 33.

The spring 27 of the pressure-limiting valve 21 and the spring 29 of the control valve 18, have, as related to the actuating portions or surfaces of these valves 18 and 21 which are acted upon by the control fluid, different configurations so that the pressure-limiting valve 21 requires, for instance, a pressure for its movement which is higher by 5 to 10 bars than that required for the control valve 18. When the pressure prevailing in the user conduit 15 reaches a level which corresponds to the adjusted actuating pressure of the regulating valve 25, the control fluid will flow through the branch conduit 17, through the communicating duct 23 via the throttle 23' and through the regulating valve 25 toward the container 33. Now, when the pressure of the fluid in the user conduit 15 increases further, the pressure prevailing in the control conduit 19 will displace the control valve 18 in its terminal position indicated by the numeral II, after which the pressurized fluid can flow from the adjusting piston 12 to the container 33. The force of the pressurized fluid which acts on the adjusting piston 11 adjusts the pump 10 to a lower throughput and to a constant value of the pressure. Now, when the pressure in the installation becomes too low, the control valve 18 is moved into its terminal position I, by spring 29 whereupon the pressurized fluid from the user conduit 15 is admitted to the adjusting piston 12 and the pump 10 is adjusted toward a higher displaced volume or to a higher pressure, that is, toward the required pressure.

Only when the pressure of the fluid in the user conduit 15 exceeds a predetermined maximum value, for instance, as a result of a failure of the control valve 18 to operate, owing, for instance, to soiling or clogging of the control valve 18 or to the inertial lag of the control valve 18 during quick dynamic changes, does the pressure-limiting valve 21 open and limits the pressure of the pressurized fluid in the user conduit 15 to a value which is only immediately above the predetermined pressure at which the pump 10 is adjusted to lower throughputs.

Figure 2:
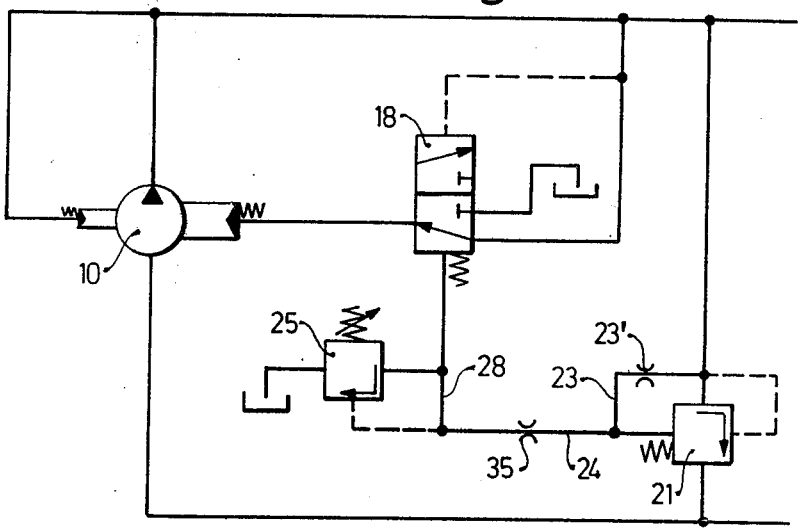
FIG. 2 is a view similar to FIG. 1 but showing a modification of the example of the embodiment of the present invention.

The modified embodiment of the present invention which is illustrated in FIG. 2 is in many respects similar to that of FIG. 1 so that the same reference numerals have been used to designate the corresponding parts. An important difference, however, resides in the fact that a further throttle, indicated by the reference numeral 35, is arranged in the communicating duct 24. The additional throttle 35 is arranged between the junctures of the communicating ducts 23 and 28 in the communicating duct 24; this means that the throttles 23' and 35 are arranged in series. This results in a situation wherein different differential pressures act on the control valve 18 and on the pressure-limiting valve 21. The differential pressures acting on the valves 18 and 21 can be selected in correspondence with the particular requirements of any given installation by correspondingly configurating and dimensioning the flow-through cross-sections of the throttles 23' and 35. The function of the arrangement illustrated in FIG. 2 is, in all other respects, the same as that discussed above in connection with FIG. 1.

It is further advantageous when the pressure-limiting valve 21 and the control valve 25 of FIG. 2 are arranged in a common housing. Under these circumstances, the throttle 23' is provided in the closing member of the regulating valve 25.

When the control arrangement of the present invention is constructed in the above-discussed manner, there is obtained a common movement of the control valve 18 and of the pressure-limiting valve 21, wherein the control stream flowing through the regulating valve 25 corresponds to that of a single regulating member. When this control arrangement is compared with that including a permanently pre-adjusted pressure-limiting valve, there is obtained the advantage that the limitation of the working pressure need not be provided at the highest possible pressure of the installation, but rather at the value of the pressure needed for the particular working presses which is, more often than not, considerably lower. As a result of this, the safety of the installation is considerably improved and the occurrence of undesired pressure peaks during the operation of the installation is avoided.

It will be understood that each of the elements described above, or two or more together, may also find a useful application in other types of constructions differing from the types described above.

While the invention has been illustrated and described as embodied in an arrangement for controlling the throughput of a radial piston pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a fluid-flow system of the type including a high-pressure conduit, a throughput-adjustable fluid-displacement machine, a throughput-adjusting device for the machine, a control valve interposed between the throughput-adjusting device and the high pressure conduit, and a pressure-limiting valve communicating with the high-pressure conduit, the improvement comprising a regulating valve commonly associated with said throughput-adjusting device via said control valve and with said pressure-limiting valve; and said control and pressure limiting valves being so constructed that the magnitude of the force required to open said pressure limiting valve exceeds that of the force required to actuate said control valve to a position thereof in which said through-put adjusting device adjusts said machine toward lower throughputs.

2. An arrangement for controlling the operation of a fluid-displacement machine of the type equipped with an adjuster which adjusts the machine toward higher or lower throughputs in dependence on the pressure of a control fluid acting thereon, comprising, in combination, a control circuit for the control fluid, having a high-pressure and a low-pressure zone; a control valve interposed between the adjuster and said zones for movement between two terminal positions in which it respectively communicates the adjuster with a different one of said zones, and having an actuating portion; means for limiting the pressure in said high-pressure zone, including a limiting valve interposed between said zones for movement between respective open and closed positions and also having an actuating portion; and means for simultaneously subjecting both of said actuating portions to respective forces which urge each of said valves toward one of said positions thereof in dependence on the pressure of the control fluid in said high-pressure zone and the magnitudes of which are in a predetermined ratio with respect to one another, including means for communicating said actuating portions of said valves with one another and with at least one of said zones of said control circuit, and a regulating valve interposed in said communicating means between said actuating portions and said one zone.

3. An arrangement as defined in claim 2, wherein the fluid-displacement machine has a high-pressure and a low-pressure port; and further comprising means for communicatingly connecting said high-pressure and low-pressure zones of said control circuit with said high-pressure and low-pressure ports of the fluid-displacement machine, respectively.

4. An arrangement as defined in claim 2, wherein said control and limiting valves are so constructed that the magnitude of the force required to move said limiting valve toward said open position exceeds that of the force required to move said control valve toward that of said terminal positions in which the adjuster adjusts the machine toward lower throughputs.

5. An arrangement as defined in claim 2, wherein said communicating means also communicates with the other of said zones; and wherein said one zone is said low-pressure zone of said control circuit.

6. An arrangement as defined in claim 5; and further comprising a throttle in said communicating means between said high-pressure zone of said control circuit and said actuating portions of said limiting and control valves.

7. An arrangement as defined in claim 6; and further comprising an additional throttle in said communicating means between said actuating portions of said limiting and control valves.

8. An arrangement as defined in claim 5; and further comprising two throttles in said communicating means between said high-pressure zone of said control circuit and said regulating valve.

9. An arrangement as defined in claim 8, wherein one of said two throttles is provided in said regulating valve.

10. An arrangement as defined in claim 8, wherein one of said two throttles is arranged in said regulating valve and the other of said two throttles is arranged in said limiting valve.

* * * * *